US010537787B2

(12) United States Patent
Pybus et al.

(10) Patent No.: US 10,537,787 B2
(45) Date of Patent: Jan. 21, 2020

(54) SPELLING GAME WITH A BLOCK OF CHARACTER LABELED DICE

(71) Applicants: Craig Pybus, Houston, TX (US); Mariyam Pybus, Houston, TX (US)

(72) Inventors: Craig Pybus, Houston, TX (US); Mariyam Pybus, Houston, TX (US)

( * ) Notice: Subject to any disclaimer, the term of this patent is extended or adjusted under 35 U.S.C. 154(b) by 0 days.

(21) Appl. No.: 15/810,130

(22) Filed: Nov. 12, 2017

(65) Prior Publication Data

US 2018/0078849 A1 Mar. 22, 2018

Related U.S. Application Data

(63) Continuation-in-part of application No. 15/002,091, filed on Jan. 20, 2016, now abandoned.
(Continued)

(51) Int. Cl.

| | |
|---|---|
| ***A63F 9/04*** | (2006.01) |
| ***A63F 9/00*** | (2006.01) |
| ***A63F 3/04*** | (2006.01) |
| *A63F 11/00* | (2006.01) |
| *A63F 3/00* | (2006.01) |
| *A63F 9/12* | (2006.01) |

(52) U.S. Cl.
CPC ..... *A63F 9/0413* (2013.01); *A63F 3/0423* (2013.01); *A63F 9/0098* (2013.01); *A63F 9/04* (2013.01); *A63F 9/0415* (2013.01); *A63F 3/00214* (2013.01); *A63F 9/1204* (2013.01); *A63F 2003/0022* (2013.01); *A63F 2003/0063* (2013.01); *A63F 2003/0426* (2013.01); *A63F 2009/0477* (2013.01); *A63F 2009/0479* (2013.01); *A63F 2009/0482* (2013.01); *A63F 2009/0488* (2013.01); *A63F 2011/0076* (2013.01)

(58) Field of Classification Search
CPC ..... A63F 9/1204; A63F 3/0423; A63F 2009/0488; A63F 9/0098; A63F 9/0413; A63F 2003/0022; A63F 2003/0426; A63F 3/00214
USPC ..... 273/146, 241, 160, 272; 434/172
See application file for complete search history.

(56) References Cited

U.S. PATENT DOCUMENTS 1,286,361 A 12/1918 Hillyard
2,886,325 A * 5/1959 Long ..... A63F 3/00214 273/157 R (Continued)

FOREIGN PATENT DOCUMENTS

EP 0 161 840 A2 11/1985
GB 308886 * 4/1929
GB 2456208 A * 7/2009 ..... A63F 9/12

*Primary Examiner* — Benjamin Layno
(74) *Attorney, Agent, or Firm* — Sherman D. Pernia

(57) ABSTRACT

Disclosed is a set of a plurality dice useful for playing a spelling game among multiple players and an exemplary method of playing the game. The plurality of dice is assembleable to form a dice block attractive for packaging. Typically, all of the dice are cube shaped and of the same dimensions. Each die of the set has each of its faces labeled with a character set consisting of one or more letters of the alphabet. The manner of play can be varied by altering the total number of individual dice in the dice set used for play, for example from 125 dice to 100 dice, by adding or removing dice specifically color-coded for that purpose. Thus the manner of play can be adjusted to alter the difficulty of play or the total time of play.

8 Claims, 3 Drawing Sheets

Related U.S. Application Data

(60) Provisional application No. 62/107,459, filed on Jan. 25, 2015.

(56) References Cited

U.S. PATENT DOCUMENTS

| | | | | |
|---|---|---|---|---|
| 5,785,319 | A * | 7/1998 | Frauhiger | A63F 9/1204 273/157 R |
| 6,199,863 | B1 | 3/2001 | Chan | |
| 6,367,798 | B1 | 4/2002 | Lawal | |
| 6,824,136 | B2 | 11/2004 | Koopman | |
| 6,945,532 | B2 | 3/2005 | Orner et al. | |
| 7,341,253 | B2 | 3/2008 | Lingenfelser | |
| 7,785,179 | B2 * | 8/2010 | Ionescu | A63F 3/0421 463/9 |
| 8,297,619 | B2 | 10/2012 | Bateng Tchounkwa | |
| 8,465,023 | B2 | 6/2013 | Scriven | |

* cited by examiner

SPELLING GAME WITH A BLOCK OF CHARACTER LABELED DICE

FIELD OF THE INVENTION

The present invention is in the field of amusement devices and games (Class 273). Specifically, the present invention relates to chance devices as an element of the game (subclass 138.1), wherein the chance devices are a set of dice (subclass 146). More specifically, the present invention relates to game pieces in a game structure (subclass 236), wherein the contest elements are disclosed as being useable in a board game, and are being used to form words (subclass 272).

BACKGROUND OF THE INVENTION

Games with multiple small parts can represent a choking hazard to younger children, especially if the small parts themselves can be broken into even smaller components, or the small parts are not easily accountable when separated from the game. Such games may be inappropriate for use around or use by young children. Additionally, game parts that have surface features such as through-apertures, which can collect and hide filth and contaminants can represent a health risk when used by young children, and can be difficult to clean. It would be beneficial to the field to have options for such games that ameliorate these risks.

An object of the present invention is to provide a spelling game using lettered cubes, wherein the total number of cubes is readily determinable, to clearly indicate when one or more cubes are missing from the set. The advantage of this feature is that a missing cube is easily detected, and can be search for, thus reducing the risk to younger children such games might otherwise represent. Additionally, another object of the present invention is that the cube components have the form factor of a simple cube—i.e., a cube that has no sub-component parts and no substantial surface features, such as apertures or holes, in which debris and filth can collect. The benefit of these objects is to reduce the health risk concern of users that have younger children in the users' environment.

Figure 1:
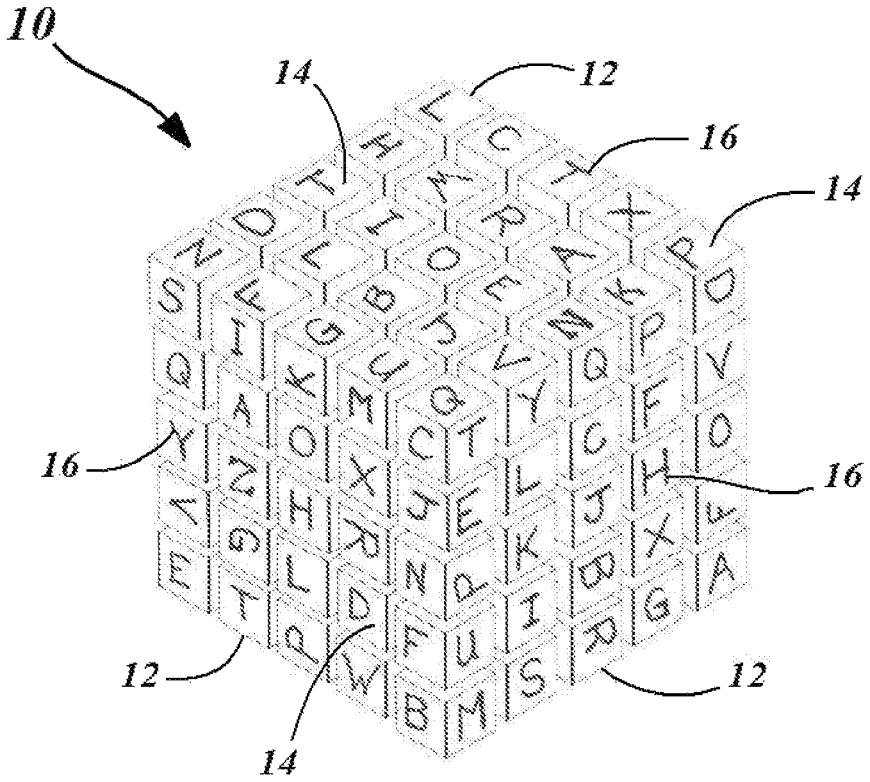
FIG. 1 is a schematic diagram illustrating the present dice set as a cube-shaped dice block composed of 125 individual die.

REFERENCES http://www.cryptograms.org/letter-frequencies.php
http://norvig.com/mayzner.html
http://norvig.com/scrabble-letter-scores.html

DESCRIPTION OF THE INVENTION

Referring now to the drawings, the details of preferred embodiments of the present invention are graphically and schematically illustrated. Like elements in the drawings are represented by like numbers, and any similar elements are represented by like numbers with a different lower case letter suffix.

Dice Organization: As illustrated in FIG. 1, the total number of individual die 12 is selected in part so that the dice set 10 can be gathered together to form a geometric shaped dice block, and in the exemplified embodiment, a cube shaped block. Other shapes are anticipated, such as a rectangular box shape. The object of the feature that the dice set 10 be readily assembleable to form a dice block having a regular geometric shape to allow easy accounting of the presence of the total number of dice 12 in the dice set 10. Optionally, a close-fitting case or container for receiving the dice block may be practiced in the present invention, to accounting for the presence of the total number of dice 12 in the dice block. In the exemplary embodiment illustrated, the total number of individual die 12 in the dice set 10 is one hundred twenty-five, which is shown formed into a cube shaped dice block of 5 die×5 die×5 die.

Dice Elements: As illustrated in the figures, all of the dice 12 are similarly sized and shaped cubes, with an individual die 12 being the smallest component part of the dice set 10. The individual dice 12 have the form factor of a simple cube—i.e., a cube that has no sub-component parts and no substantial surface features, such as apertures or holes, in which debris and filth can collect. Each of the six faces on each die 12 displays at least one typographical character set 16. Preferable, in the embodiment exemplified herein, each of the six die faces 14 of an individual die 12 has represented thereon a character set 16 of one to three alpha-characters, that is: English language alphabetical letters. The majority of die faces 14 will display a character set 16 consisting of only a single letter. However, some die faces 14 will display a "digram" or "trigram" character set 16, as explained below. The total number of individual die 12 in the dice set 10 is in part influenced by the level of initial difficulty desired when playing the game: fewer total dice can raise the initial difficulty of the game.

Letter Frequency & Distribution: The relative frequency of usage in the English language of each of twenty-six letters in the English alphabet was determined from the literature (see supra). The reported frequency of usage was then used to determine an initial frequency of appearance of each alpha-character/letter (e.g., the letter "A") to be used in the total number of letters displayed on the die faces 14 of the individual die 12 in the dice set 10 (having seven hundred fifty dice faces 14 in the presented embodiment). The characters 16 were further distributed to avoid duplication of a character 16 on the faces of any single die 12. As noted below, the reported frequency of usage was only useful as a starting point. However, in view of the teachings stated herein, this can be adapted by the skilled artisan and for the purposes of accomplishing the present invention.

Figure 2:
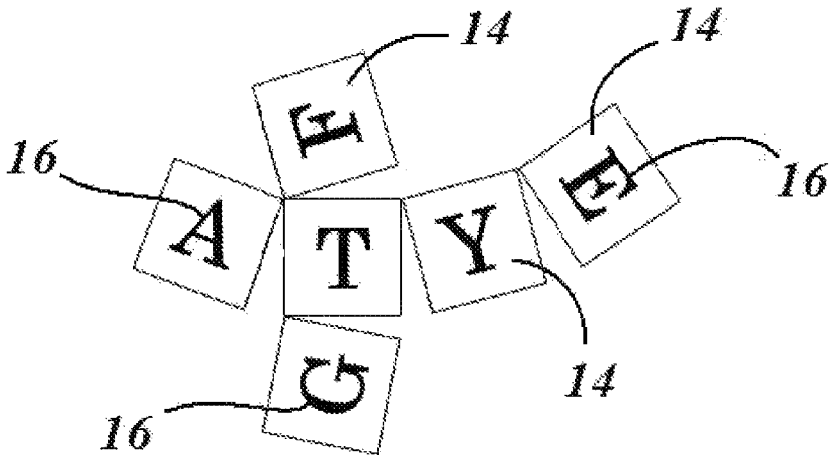
FIG. 2 is a schematic diagram of the six faces of a single die of the present invention illustrating the layout and orientation of the character set on each face relative to each other.
Figure 3:
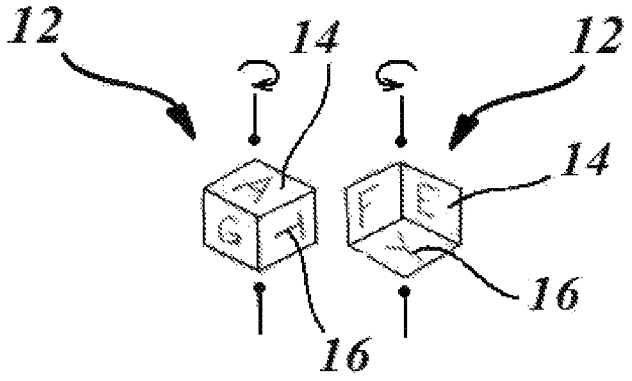
FIG. 3 is a schematic diagram illustrating the layout and orientation of the character set on each face of a die to enable a player to rotate a die 180° in either direction to easily view all six characters sets on the die.

Character Orientation: As illustrated in FIG. 2, the character sets 16 displayed on the die surface 14 of a die 12 are oriented so that as a player turns a die 12, the letters thereon are easily viewable to facilitate word formation.

Board Element: The game of the present invention can utilize a game board (not shown) for the purpose of providing a level playing surface on which to position and display the dice 12 played to form words. A game board embodying specific content is not required, which makes the other elements of the game (specifically, the dice set 10) separately portable and playable on any flat surface. However, a game/playing board may be included as a feature of the game if it is desired to have a means to more affirmatively hold played dice 12 in place. For example, a board having a pattern of square detents/depressions in its surface for positioning and holding played dice, or a board with a magnetic surface for use with dice 12 having a paramagnetic feature (or vice-versa).

Construction Materials: Individual die cubes 12 can be constructed of a variety of materials and in a variety of colors, as is known in the art. Additionally, individual die 12 can be constructed to incorporate a paramagnetic material (e.g., iron filings) that would allow scattered dice to be gathered together with a magnetic material, or allow played dice 12 to be held on a magnetic playing surface (board). Character font and die face 14 colors can be modified to change the manner and level of play of the game. For example, an embodiment of the game can have a number of different colored dice 12, different colored die faces 14, or different colored character/letters 16 on individual die 12, or a combination thereof for any single die 12. This can allow for a point advantage for a play utilizing characters and/or cubes of the same color; culling a specific group of dice from the dice block 10 to increase the initial difficulty of play; and so forth.

Benefit: The frequency and distribution of characters 16 (letters) and the relatively large number of total characters (seven hundred fifty compared for example to one hundred tiles for the English edition of Scrabble®) initially available for play in a dice block 10, affords the opportunity to make initial play relatively easy. The ability to add or remove a certain group (or groups) of color-coded (or otherwise differentiated) die 12 from the dice block 10 allows players to selectively adjust/alter the manner of play (e.g., the time or difficulty) of the game.

The selection of characters 16 presented on the dice set 10 was purposed to ensure that the distribution of characters overall and on each die 12 to facilitate game play. For the one hundred twenty-five dice block 10 exemplified herein, the frequency and distribution of characters 16 in the character set displayed thereon was devised as outlined below:

Step 1

Identify the total number of characters to be represented by the dice block:

A=total number of die 12 in the dice block 10;

B=number of sides 14 on each die 12; and

C=total number of characters 16 that can be represented by the dice block 10.

Therefore, for the dice block 10 of one hundred twenty-five dice in the instant example:

(A×B=C or 125 (total dice)×6 (side/die)=750 (total characters)) a total of seven hundred fifty die faces 14 are available to display characters 16.

Step 2

Determinations of the usage frequency of each letter in the English alphabet are available in the literature. See for example: www.cryptograms.org/letter-frequencies.php; http://norvig.com/mayzner.html; and http://norvig.com/scrabble-letter-scores.html.

Information that was found in the literature turned out not to be directly applicable to the present invention as embodied herein. For example, sometimes application of the cited usage frequencies resulted in an inappropriate number of total die faces 14: e.g., 752 instead of 750. This did not provide the correct total number of letters or a ratio of vowels to consonants that would be relatively easy to distribute across the number of dice 12 in the disclosed dice set 10, and certain letters since, their usage frequency was low, were completely omitted.

However, from a combination of the selected frequency analyses reported in the literature, the following method was experimentally extrapolated for use with designing the dice set 10 of the present game. Selected usage frequencies were compared, combined and adjusted to make the following accommodations: for those letters that had less than 1% usage the frequency was increased to 1%; and other letter frequencies were adjusted down to compensate. Although this initiative adaptation appeared better, it still did not provide the appropriate formula for the desired distribution of vowels and consonants across the 750 faces 14 of 125 dice 12.

Subsequently, an adjustment was made to the number of each of the letters to ensure that there were two vowels per die therefore a total of 250 vowels to 500 consonants. This distribution of vowels to consonants proved to provide a lower distribution of usage frequency of vowels compared to the statistical sources used for letter frequency usage, but it provided an easier method to ensure that the desired number of vowels was available on each die 12 for word formation during a game. It is desired that letters with lower frequency of use be capped at some number, which in the present case was a total of nine for the letters: B, J, K, Q, V, X and Z. See, for example, Table 1 and Exhibit A.

TABLE 1

| Letter: | Number: | Percent: |
|---|---|---|
| A | 55 | 7.3% |
| B | 9 | 1.2% |
| C | 23 | 3.1% |
| D | 32 | 4.3% |
| E | 84 | 11.2% |
| F | 16 | 2.1% |
| G | 16 | 2.1% |
| H | 38 | 5.1% |
| I | 47 | 6.3% |
| J | 9 | 1.2% |
| K | 9 | 1.2% |
| L | 32 | 4.3% |
| M | 16 | 2.1% |
| N | 53 | 7.1% |
| O | 47 | 6.3% |
| P | 16 | 2.1% |
| Q | 9 | 1.2% |
| R | 47 | 6.3% |
| S | 48 | 6.4% |
| T | 68 | 9.1% |
| U | 17 | 2.3% |
| V | 9 | 1.2% |
| W | 16 | 2.1% |
| X | 9 | 1.2% |
| Y | 16 | 2.1% |
| Z | 9 | 1.2% |
| Total | 750 | 100.0% |

Step 3

Once the character/letter set had been determined, the characters 16 were distributed across the 750 dice faces 14 of the 125 dice 12. In accomplishing this, all of the vowels were allocated first by placing two vowels on each die, while ensuring no vowel was duplicated on the same die 12. The consonants were then 'layered in' (i.e., allocated by placing four consonants on each die 12, while ensuring no consonant was duplicated on the same die) and a "sumif" formula in Excel® was utilized to track the letters used, and to flag letters that were over the expected quota. Using this methodology all 750 letters were distributed across the 750 dice faces 14 of the 125 dice 12, with no two dice having the same letter combination.

Step 4

In this step the most popular digrams/digraphs were checked against the letters that had been selected on individual die 12 to determine the percentage of digrams across all 125 dice 12 of the dice block 10. A digram or digraph is a pair of letters, or a letter-pair that can be used to represent a single sound or phoneme, such as: TH, HE, RE, AN, IN and QU. With this information the consonant distribution determined in step 3 were shifted to try to limit the number of digrams on each die so that there is more optionality for word formation across multiple dice. This is just a consideration for the selection and distribution of letter/characters to facilitate the ease of forming words during game play. See, for example, Table 2.

TABLE 2

| Number of Digrams | | |
|---|---|---|
| Digram | Number | Percent |
| TH | 12 | 10% |
| HE | 18 | 14% |
| RE | 16 | 13% |
| AN | 18 | 14% |
| IN | 10 | 8% |
| QU | 0 | 0% |
| Total Digrams | 74 | 59% |

Step 5

The frequency of occurrence of trigrams was determined across the character sets 16 of each die 12, and reduce these occurrences to as few as possible. A trigraph is a group of three letters and/or a three-letter set used to represent a single sound (phoneme) or a combination of sounds that does not correspond to the written letters combined. The trigraphs that were used for this step in the present invention are THE, ING, ION, AND and ENT). Although in a preferred embodiment, only one trigram at most appears on any one die 12, the appearance of more than one trigram could be practice on a single die 12 if desired. See, for example, Table 3. The same may be practiced for the occurrence of digrams on a single die 12 as well.

TABLE 3

| Number of Trigrams | | |
|---|---|---|
| Trigram | Number | Percent |
| ING | 0 | 0% |
| ION | 3 | 2% |
| AND | 2 | 2% |
| THE | 4 | 3% |
| ENT | 12 | 10% |
| Total Trigrams | 21 | 17% |

Figure 4:
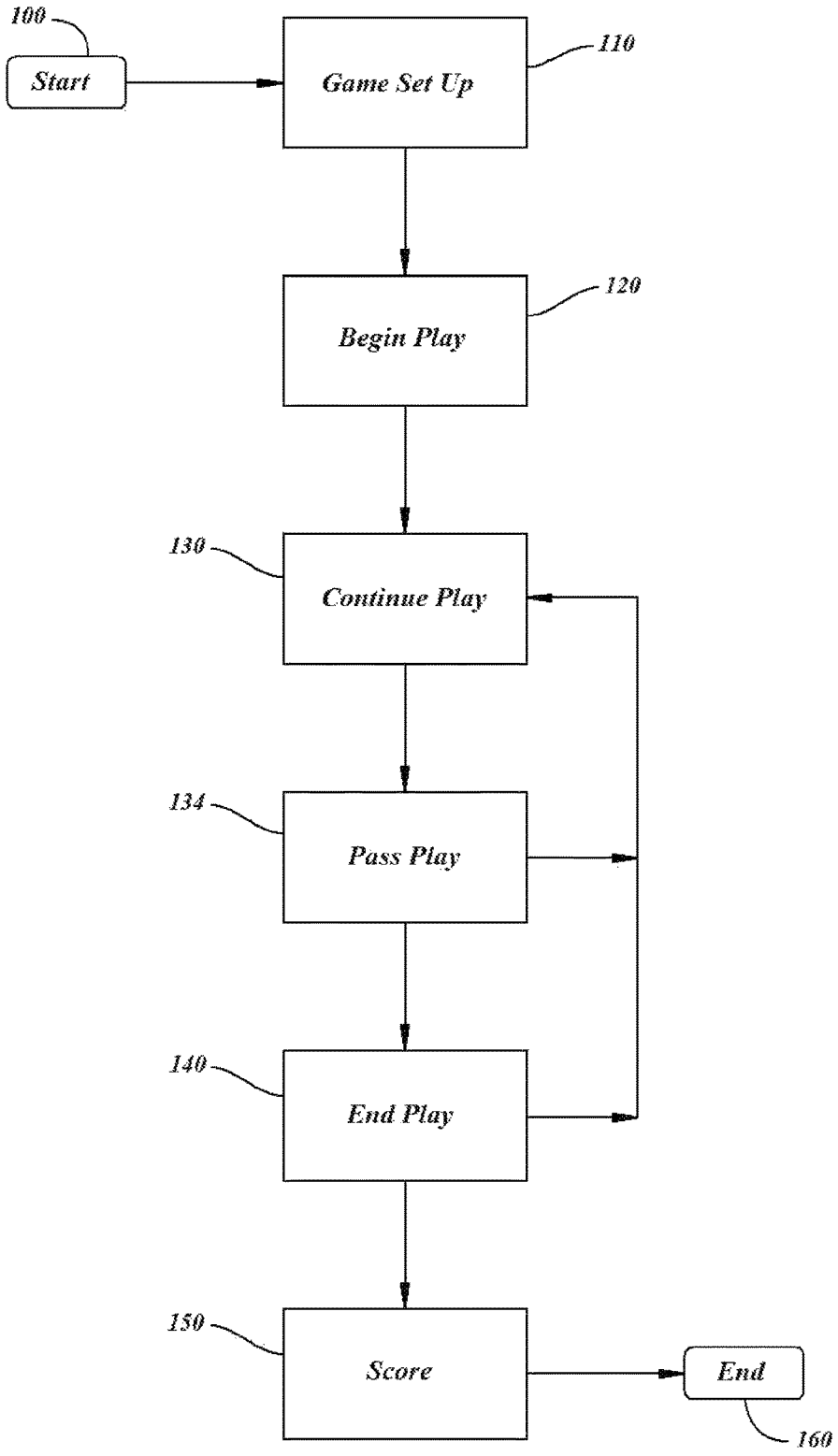
FIG. 4 is a flow chart illustrating an example of a method for utilizing the present dice set in a spelling game.

Example Game: E.g., for 2 to 6 players; age 5 and older, see FIG. 4.

Start 100

Place all the dice 12 in an aggregation or "stack" (e.g., in a drawstring bag, a hopper, a pile, etc.).

Mix the dice 12 in the aggregation to randomize their distribution.

Game Set Up 110

A series/circle of players is established, and each player draws a hand of a number (e.g., seven) dice 12 (game pieces) from the aggregation.

The remaining dice 12 are left in the aggregation for further draws during play.

Note: Each player may choose from all of the letters displayed on a dice surface 14 of each of the dice 12 in their hand to make a word. Thus a full hand has 6×7, or forty-two characters sets (letters, digrams or trigrams) available from which to construct a word, as opposed to only seven in a full Scrabble® hand.

Begin Play 120

To begin play, a first player constructs a word from his/her hand and places it in the playing area; the word being formed by the ordered display of characters 16 on the top face of the pieces/dice 12 played The first player then draws a number of dice 12 from the aggregation in order to maintain a full hand of game pieces/dice, and complete the player's turn.

Continue Play 130

Play is continued by proceeding around the series of players, and having a next player construct a word from his/her hand that can play off of a letter of an existing word already played, and similarly place his/her word in the playing area. This player then draws a number of dice 12 from the aggregation in order to maintain a full hand of game pieces/dice, and to complete that player's turn, until no game pieces/dice remain in the aggregation.

Note: The character 16 displayed on the top face of the played dice 12 is used for word formation. The characters on the side and the bottom faces are not available for play, unless used with a three-dimensional game board (not shown) that allows display of die faces 14 and formation of words in a vertical direction.

Pass Play 134

In the event a player is unable to play a word, he/she must pass their turn.

End Play 140

The game can be ended when no game pieces/dice remain in the aggregation; one or more players have played all of their game pieces; and/or when all players in series have passed their turn.

Scoring 150

Calculate a score for each player: starting from a score of zero points.

Add to a player's score the points made on each turn played. Score the played dice as agreed in advance (e.g., in view of special consideration for differentiated (e.g., color coded) dice or characters, or by a character set point value scheme).

If a player is able to make a new word while at the same time adding on to an existing word in the playing area, add one point for each letter in both words.

At the end of play, subtract from a player's score for each die or points remaining in his/her hand.

End 160

The game is over and the player with the most points wins!

To practice the invention with a higher level of difficulty, each player rolls selected dice and must use the character displayed on the top surface of the rolled dice. Additionally, a timer can be utilized to limit the time each player may take (e.g., to two minutes) to make a word and to place it in the playing area. Further, a "handicap" point system can be utilized to normalize the advantage/disadvantage different players may have, for example because of age differences between the players.

Additionally, the difficulty of play can be adjusted by altering the size of the starting dice set 10, for example from 125 dice to 100 dice. However, adjusting the size of the dice set requires recalculating the frequency distribution of letters in the dice set 10, in order to maintain the general quality of the game's play. This can be accomplished in advance, for example by: color-coding selected individual dice 12, or one or more selected die surfaces 14 of selected individual dice 12, etc. Then, simply adding or removing dice specifically color-coded for that purpose adjusts the difficulty of play.

While the above description contains many specifics, these should not be construed as limitations on the scope of the invention, but rather as exemplifications of one or another preferred embodiment thereof many other variations are possible, which would be obvious to one skilled in the art. Accordingly, the scope of the invention should be determined by the scope of the appended claims and their equivalents, and not just by the embodiments.

What is claimed is:

1. A dice set (10) of character labeled dice (12) for use by young players of a spelling game to spell words, the dice set (10) comprising:

a plurality of character labeled dice (12), the plurality being a total number of dice (12) ranging between 64 and 343 dice (12), with an individual die (12) being the smallest component part of the dice set (10);

each die (12) of said dice set (10) having a form factor of a simple cube having no substantial surface features in which debris can collect, and each die (12) being of similar size and shape and having six die surfaces (14) with each die surface (14) displaying a character set (16);

the displayed character set (16) being selected from the group of character sets consisting of: a single alphabetical letter; a phoneme digram; or a phoneme trigram;

the die surfaces (14) of the plurality of character-labeled dice (12) of the dice set (10) displaying individual character sets (16) with a frequency of occurrence for all alphabetical letters of at least 1%, and a distribution of two different vowels, or one vowel and one phoneme per die (12) for an overall distribution substantially of one vowel per two consonances with no duplications on the same die (12) with no two dice having the same letter combination; and the dice set (10) being readily assembleable to form a dice block appropriate for use in said spelling game by young children, the dice block having a regular geometric shape to allow easy accounting of a presence of the total number of dice (12) in the dice set (10).

2. The dice set (10) of character labeled dice of claim 1, wherein the plurality of character-labeled dice (12) is 125 total dice.

3. The dice set (10) of character labeled dice of claim 1, wherein a die surface (14) displaying a character set (16) that is a digram displays a digram selected from the group of letter-pairs consisting of: TH; HE; RE; AN; IN; and QU.

4. The dice set (10) of character labeled dice of claim 1, wherein a die surface (14) displaying a character set (16) that is a trigram displays a trigram selected from the group of three-letter sets consisting of: THE; ING; ION; AND; and ENT).

5. The dice set (10) of character labeled dice of claim 1, wherein each die (12) of said dice set (10) is a cube of the same size and has die surfaces (14) with each die surface (14) displaying a character set (16), and the six surfaces (14) of each die (12) disposed relative to the character sets (16) on the other die surfaces (14) to facilitate the character sets (16) thereon being easily viewable for word formation as a player turns the die (12).

6. The dice set (10) of character labeled dice of claim 1, wherein the plurality of character-labeled dice (12) is a total number of dice selected to allow the dice set (10) to be assembleable to form a dice block having a regular geometric shape selected from the group of geometric shapes consisting of: a cube shape, and a rectangular box shape.

7. The dice set (10) of character labeled dice of claim 1, wherein certain of the dice (12) are color-coded to allow them to be easily recognized and separated from or returned to the dice set (10) to adjust manner of play.

8. The dice set (10) of character labeled dice of claim 1, further comprising a close-fitting container for containing in the dice block, and for visually accounting for the presence of the total number of dice (12) in the dice block.

* * * * *